US007662242B2

(12) United States Patent
Miyazaki et al.

(10) Patent No.: US 7,662,242 B2
(45) Date of Patent: Feb. 16, 2010

(54) NON-ORIENTED ELECTRICAL STEEL SUPERIOR IN CORE LOSS

(75) Inventors: Masafumi Miyazaki, Futtsu (JP); Wataru Ohashi, Futtsu (JP); Yousuke Kurosaki, Futtsu (JP); Takeshi Kubota, Futtsu (JP); Hiroshi Harada, Himeji (JP); Tomohiro Konno, Himeji (JP); Yutaka Matsumoto, Kitakyushu (JP); Koichi Kirishiki, Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 119 days.

(21) Appl. No.: 11/666,844

(22) PCT Filed: Sep. 28, 2005

(86) PCT No.: PCT/JP2005/018392

§ 371 (c)(1),
(2), (4) Date: May 1, 2007

(87) PCT Pub. No.: WO2006/048989

PCT Pub. Date: May 11, 2006

(65) Prior Publication Data

US 2008/0112838 A1 May 15, 2008

(30) Foreign Application Priority Data

Nov. 4, 2004 (JP) ..... 2004-320757
Nov. 4, 2004 (JP) ..... 2004-320804

(51) Int. Cl.
*H01F 1/147* (2006.01)

(52) U.S. Cl. ..... 148/309; 148/111; 148/121; 148/306; 148/307

(58) Field of Classification Search ..... None
See application file for complete search history.

(56) References Cited

U.S. PATENT DOCUMENTS 6,290,783 B1 * 9/2001 Kawano et al. ..... 148/309

(Continued)

FOREIGN PATENT DOCUMENTS

EP 0 678 878 10/1995

(Continued)

OTHER PUBLICATIONS

Russian Office Action dated Sep. 24, 2008 issued in corresponding Russian Application No. 2007120509/02(022341).

(Continued)

*Primary Examiner*—John P. Sheehan
(74) *Attorney, Agent, or Firm*—Kenyon & Kenyon LLP

(57) ABSTRACT

Non-oriented electrical steel sheet superior in core loss characterized by containing, by mass %, C: 0.01% or less, Si: 0.1% to 7.0%, Al: 0.1% to 3.0%, Mn: 0.1% to 2.0%, N: 0.005% or less, Ti: 0.02% or less, REM: 0.05% or less, S: 0.005% or less, O: 0.005% or less, and a balance of iron and unavoidable impurities and having a mass % of S shown by [S], a mass % of O shown by [O], a mass % of REM shown by [REM], a mass % of Ti shown by [Ti], and a mass % of N shown by [N] satisfying [Formula 1] and [Formula 2]:

$$[REM]^2\times[O]^2\times[S]\geqq 1\times10^{-15} \quad \text{[Formula 1]}$$

$$([REM]^2\times[O]^2\times[S])\div([Ti]\times[N])\geqq 1\times10^{-10} \quad \text{[Formula 2].}$$

4 Claims, 2 Drawing Sheets

U.S. PATENT DOCUMENTS

| | | | | |
|---|---|---|---|---|
| 6,478,892 | B2 * | 11/2002 | Murakami et al. | 148/306 |
| 2002/0066500 | A1 * | 6/2002 | Kawano et al. | 148/111 |
| 2006/0243351 | A1 * | 11/2006 | Ohashi et al. | 148/112 |

FOREIGN PATENT DOCUMENTS

| | | |
|---|---|---|
| EP | 1 632 582 | 3/2006 |
| JP | 51-62115 | 5/1976 |
| JP | 56-102550 | 8/1981 |
| JP | 58-1172 | 1/1983 |
| JP | 59-74212 | 4/1984 |
| JP | 59-20731 | 5/1984 |
| JP | 8-3699 A | 1/1996 |
| JP | 10-212556 A | 8/1998 |
| JP | 11-158550 | 6/1999 |
| JP | 3037878 | 2/2000 |
| JP | 2005-336503 A | 12/2005 |

OTHER PUBLICATIONS

European Search Report, dated Sep. 18, 2009, issued in corresponding European Patent Application No. 05790122.5.

* cited by examiner

NON-ORIENTED ELECTRICAL STEEL SUPERIOR IN CORE LOSS

TECHNICAL FIELD

The present invention provides non-oriented electrical steel sheet superior in core loss, in particular core loss after stress-relief annealing, which lowers the core loss of the non-oriented electrical steel sheet used for motor cores etc., reduces the energy loss, helps make electrical equipment more efficient, and contributes to energy savings.

More specifically, the present invention makes TiN sufficiently coprecipitate in REM sulfides in non-oriented electrical steel sheet and thereby provides non-oriented electrical steel sheet which decreases the solid solution Ti in the steel, suppresses the precipitation of fine TiC easily occurring at low temperature parts when annealing the steel sheet, and as a result is superior in crystal grain growth and low in core loss.

BACKGROUND ART

Non-oriented electrical steel sheet is known to become minimum in core loss at a grain size of 150 μm or so. In the finish annealing process, the crystal grains are therefore grown. For this reason, from the viewpoint of product core loss or from the viewpoint of the simplification of production and raising productivity, steel sheet with better crystal grain growth characteristics in the finish annealing is therefore desired.

On the other hand, electrical steel sheet is stamped by the consumer for use for producing cores. The smaller the grain size, the better the stamping precision in the stamping operation. The grain size is therefore, for example, 40 μm or less.

Therefore, sometimes the measure is taken of shipping the product sheet with the small grain size, then having the consumer stamp it, then for example perform stress relief annealing at 750° C.×2 hours or so to grow the crystal grains.

In this case, consumers increasingly demand product sheets with good growth potential of the crystal grains even with low temperature, short time stress relief annealing so as improve productivity.

One of the primary factors that obstruct crystal grain growth is the inclusions finely dispersed in the steel. It is known that the greater the number of inclusions contained in the product and the smaller their size, the more the crystal grain growth is obstructed.

That is, as indicated by Zener, the smaller the r/f value as expressed by the spherical equivalent radius r of the inclusions and the volume fraction f of the inclusions in the steel, the worse the crystal grain growth. Consequently, in order to improve the crystal grain growth, the number of inclusions must, of course, be reduced and it is critical to increase the size of the inclusions.

As fine inclusions that obstruct crystal grain growth of the non-oriented electrical steel sheet, oxides such as silica and alumina, sulfides such as manganese sulfide, and nitrides such as aluminum nitride and titanium nitride are known.

In order to eliminate these fine inclusions or decrease them to the necessary and sufficient level, it is self-evident that the purity should be increased at the molten steel stage.

However, eliminating these fine inclusions or decreasing them to the necessary and sufficient level by increasing the purity at the molten steel stage is not preferable since an increase in the steelmaking cost is unavoidable.

Therefore, as other methods, several methods are known of adding various elements to the steel ensure to render the inclusions harmless.

For the oxides, technological advances have made it possible to eliminate and render harmless oxides at the molten steel stage by adding a sufficient amount of the strong deoxidizing element Al and allowing sufficient time for the flotation and removal of oxides.

For the sulfides, for example, as disclosed in Japanese Patent Publication (A) No. 51-62115, Japanese Patent Publication (A) No. 56-102550, Japanese Patent Publication (A) No. 59-74212, Japanese Patent No. 3037878, etc., the method is known of adding rare earth elements (below called "REM"), which are desulfurization elements, etc. so as to increase the size of S inclusions and render them harmless.

Further, for nitrides, as disclosed in Japanese Patent No. 1167896 and Japanese Patent No. 1245901, the method for rendering N harmless as coarse inclusions by the addition of B is well known.

However, even if using the above stated methods to eliminate oxides, sulfides, and nitrides of non-oriented electrical steel sheet or increase the size of the inclusions to render them harmless and then perform the finish annealing or stress relief annealing, the crystal grains will partially vary in growth and fine crystal grains and coarse crystal grains will be mixed together—sometimes leading to poor core loss.

The cause, it has been found, is the fine titanium carbides (below called "TiC"), derived from the Ti and C which had been in solid solution at the stage of the finish annealing or stress relief annealing, precipitating at parts of the product sheet and obstructing the growth of the crystal grains. This will be explained specifically below.

Non-oriented electrical steel sheet is often treated by finish annealing or stress relief-annealing at a comparatively low temperature of 1000° C. or less. In particular, stress relief annealing is performed at 750° C. or so or at a further lower temperature to prevent wear of the surface coating of the product sheet.

Therefore, in order to sufficiently grow crystal grains at such a low temperature, it is necessary to perform the annealing over a long time of 1 hour or more.

With annealing at this low temperature and long time, it is difficult to control the temperature of the product sheet to become uniform over the entire surface at all times. Parts of the product sheet become lower in temperature, while other parts become higher in temperature, i.e., a variation often occurs in the temperature distribution.

Incidentally, when TiC precipitates in electrical steel, it has been learned from separate studies that it precipitates within a range of 700 to 800° C., particularly actively precipitates at 750° C. or less.

Consequently, in annealing at a low temperature over a long time, at the parts where the temperature of the product sheet becomes relatively high, the precipitation temperature of TiC is exceeded, so TiC does not precipitate. Further, since these parts are high in temperature, the crystal grain growth rate is also fast. Therefore, the crystal grains of these parts become coarse in size.

On the other hand, at the parts where the temperature of the product sheet becomes relatively low, the temperature is less than the precipitation temperature of TiC, so TiC precipitates during the annealing.

In particular, the TiC produced under a low temperature, due to the low temperature, cannot grow to TiC of a sufficient size and becomes fine, so obstructs crystal grain growth during annealing over a long time.

Since the TiC particles precipitating in this case are fine, even if the amount of Ti and the amount of C contained in the steel are high ones of several ppm, sometimes a number of TiC particles sufficient for obstructing crystal grain growth will precipitate.

Furthermore, at the parts where the temperature of the product sheet is relatively low, due to the low temperature, the growth rate of the crystal grains itself is slow and therefore the effect of the fine TiC particles obstructing crystal grain growth becomes stronger. Therefore, the crystal grains do not sufficiently grow and remain fine.

In this manner, the reduction of the annealing temperature or the unavoidable variation in the annealing temperature causes variation in presence of TiC in the electrical steel sheet and consequently variation in crystal grain growth in the electrical steel sheet.

DISCLOSURE OF THE INVENTION

The present invention has as its object the provision of non-oriented electrical steel sheet enabling sufficient growth of crystal grains and reduction of core loss by suppressing the precipitation of the fine TiC which had somewhat inevitably been generated at the low temperature parts during finish annealing or stress relief annealing.

The gist of the present invention for achieving this object is as follows:

(1) Non-oriented electrical steel sheet superior in core loss characterized by containing, by mass %, C: 0.01% or less, Si: 0.1% to 7.0%, Al: 0.1% to 3.0%, Mn: 0.1% to 2.0%, N: 0.005% or less, Ti: 0.02% or less, REM: 0.05% or less, S: 0.005% or less, O: 0.005% or less, and a balance of iron and unavoidable impurities and having a mass % of S shown by [S], a mass % of O shown by [O], a mass % of REM shown by [REM], a mass % of Ti shown by [Ti], and a mass % of N shown by [N] satisfying [Formula 1] and [Formula 2]:

$$[REM]^2\times[O]^2\times[S]\geqq 1\times10^{-15} \quad \text{[Formula 1]}$$

$$([REM]^2\times[O]^2\times[S])\div([Ti]\times[N])\geqq 1\times10^{-10} \quad \text{[Formula 2]}$$

(2) Non-oriented electrical steel sheet superior in core loss according to (1) characterized by further containing, by mass %, at one least one of P: 0.5% or less, Cu: 3.0% or less, Ca and Mg: 0.05% or less, Cr: 20% or less, Ni: 5.0% or less, a total of one or both of Sn and Sb: 0.3% or less, Zr: 0.01% or less, V: 0.01% or less, and B: 0.005% or less.

(3) Non-oriented electrical steel sheet superior in core loss according to (1) or (2), characterized by further containing, by mass %, Ti: 0.0015% to 0.02% and REM: 0.00075% to 0.05% and having a mass % of REM shown by [REM] and a mass % of Ti shown by [Ti] satisfying $[REM]\div[Ti]\geqq 0.5$.

(4) Non-oriented electrical steel sheet superior in core loss according to any one of (1) to (3), characterized in that the non-oriented electrical steel sheet contains REM oxysulfides having cracks or fractures and having a size of 1 μm to 5 μm and in that the ratio of the number of REM oxysulfides bonded with TiN in the REM oxysulfides having cracks or fractures and having a size of 1 μm to 5 μm is 5% or more.

According to the present invention, it is possible to sufficiently suppress fine TiC precipitating in non-oriented electrical steel sheet, possible to maintain good crystal grain growth at the finish annealing or stress relief annealing stage, and obtain sufficiently good magnetic properties. The present invention satisfies consumer needs and can contribute to energy savings.

BEST MODE FOR CARRYING OUT THE INVENTION

Figure 1:
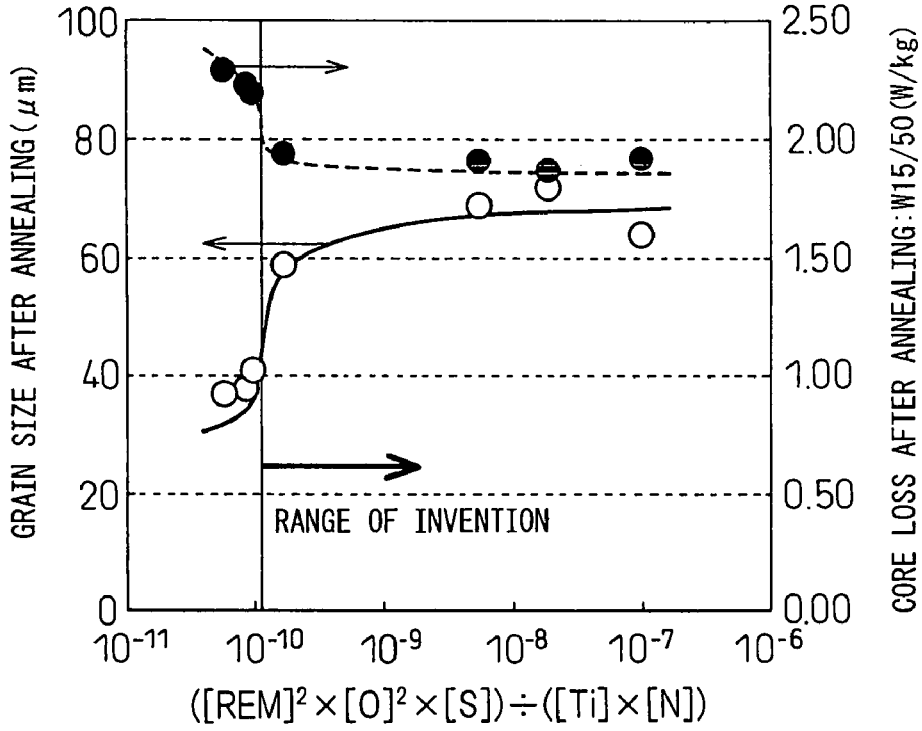
FIG. 1 is a view showing the correlation between the values calculated from the amount of REM, the amount of S, and the amount of N in the steel using [Formula 1] of the present invention and the grain size and core loss value after stress relief annealing.

Below, the mechanism of action of the present invention will be explained in detail.

As explained above, the technology of forming REMs when rendering the sulfides in electrical steel harmless, that is, the technology of fixing S in coarse REM sulfides by addition of REMs and reducing the other sulfide-based inclusions, has been known since the past.

In the present invention, "REM" is the general name for the total 17 elements of the 15 elements from lanthanum of atomic number 57 to lutetium of 71 plus scandium of atomic number 21 and yttrium of atomic number 39.

The present inventors studied in detail the phenomenon occurring due to the addition of REM to electrical steel. As a result, the facts shown in the following 1) to 5) become clear:

1) The REM oxysulfides in steel have a higher coprecipitation ability of TiN than REM sulfides.

2) REM oxysulfides can be sufficiently formed in steel by making the amounts of REM, O, and S in the steel within the suitable ranges.

3) Furthermore, TiN can be made to coprecipitate on the surfaces of the REM oxysulfides by making the amounts of Ti and N within the suitable ranges.

4) Furthermore, when the REM inclusions have cracks or fractures, TiN will preferentially coprecipitate on the cracks or fractures.

5) In the above way, by fixing a large amount of Ti in the steel by coprecipitation on the REM oxysulfides in the form of TiN, it is possible to suppress the precipitation of fine TiC conventionally somewhat inevitably occurring at the low temperature parts during finish annealing or stress relief annealing and obtain low core loss non-oriented electrical steel sheet with good growth of crystal grains.

These facts are explained in detail below.

REMs react with a variety of elements in steel to form inclusions, but as examples, there are REM oxysulfides, REM sulfides, REM oxides, and so on.

Figure 2:
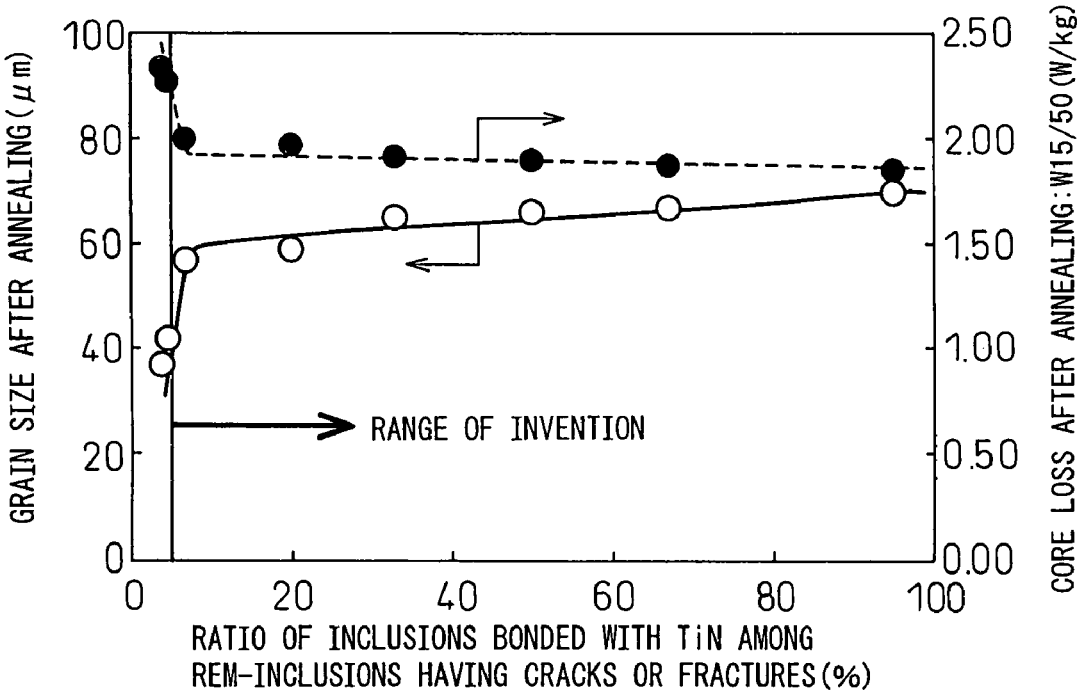
FIG. 2 is a view showing the correlation between the ratio of number of REM inclusions having cracks or fractures with respect to the number of REM inclusions having a size of 1 μm to 5 μm contained in the product and the grain size and core loss value of the product after annealing.

The crystalline structures of these REM inclusions resemble the crystalline structure of TiN in many points, so when steel contains these REM inclusions, as shown in FIG. 2, sometimes the TiN coprecipitates in a form geometrically matching with the REM inclusions.

In particular, even among the REM inclusions, the crystalline structures of REM oxysulfides particularly resemble the crystalline structure of TiN in many points, so coprecipitation of the two occurs more frequently than coprecipitation with other REM inclusions and the strength is greater.

On the other hand, TiC and REM oxysulfides have crystalline structures not resembling each other to the extent of the resemblance of the crystalline structures of TiN and REM oxysulfides, so it is rare that TiC would. coprecipitate with REM oxysulfides.

However, the precipitation start temperature of TiN is 1200 to 1300° C. Further, the precipitation start temperature of TiC is 700 to 800° C. The fact that precipitation starts actively in particular at 750° C. or less is clear from separate studies.

For this reason, in the cooling process of casting or the cooling process after slab reheating and other conditions of a comparatively high temperature, Ti coprecipitates as TiN with the REM oxysulfides and is fixed.

Once Ti is fixed as TiN, TiN will not redissolve in the relatively low temperature state of the finish annealing of the product sheet or stress relief annealing after stamping, so the Ti necessary for the precipitation of TiC in the product sheet is consumed and consequently TiC will not precipitate.

Consequently, the REM oxysulfides in the steel are formed more selectively than other REM inclusions. If setting suitable conditions enabling TiN to coprecipitate with this, Ti can be fixed in the form of TiN coprecipitated on the REM oxysulfides and the action of TiC on obstructing crystal grain growth can be reduced.

Precipitation of REM oxysulfides involves the solubility product of the component elements REM, O, and S. That is, for the precipitation of REM oxysulfides, the value expressed in the form of the product of the amount of REM, the amount of O, and the amount of S in the steel (solubility product) has to exceed a predetermined value.

On the other hand, in regards to Ti, it is necessary that TiN precipitate and sufficiently grow. In particular, to enable the Ti in steel to be fixed as TiN, it is necessary that Ti and N for growing TiN be sufficiently contained in the steel.

Precipitation of TiN involves the solubility product of the component elements Ti and N. That is, for the precipitation of TiN, the solubility product expressed in the form of the product of the amount of Ti and the amount of N in the steel must exceed a predetermined value.

However, when adjusting the amount of Ti and the amount of N in the steel to become excessive so as to increase the value expressed in the form of the product of the amount of Ti and the amount of N, all of the Ti and N in steel will not be fixed as TiN on the REM oxysulfides, and excess Ti and excess N failing to form TiN will end up remaining. Due to this, sometimes TiC and AIN or other precipitates will form and conversely the crystal grain growth will be obstructed.

Therefore, the solubility product of Ti and N must be kept to a ratio of a certain value or less with respect to the solubility product of REM, O, and S.

Note that the REM oxysulfides in the steel are lower in hardness than the steel, so if the steel is rolled, forged, or otherwise processed, they will be stretched or will be crushed and form cracks or fractures.

After the processing, which form the REM oxysulfides take and which extent of cracks and fractures occur will vary according to the processing conditions. However, according to the ordinary method of production of electrical steel sheet, usually at least one-third of the REM oxysulfides in the steel will have cracks or fractures.

Before the steel is processed in the above way, the REM oxysulfides sometimes are covered on their surfaces with compounds other than TiN (for example, AIN and the like) bonded to them. However, when the above processing causes the surfaces of the REM oxysulfides to crack or fracture, since compounds other than TiN will not be bonded to the cracks or fractures, TiN will be easily formed.

For this reason, the cracks or fractures of the REM oxysulfides are more amendable to coprecipitation of TiN than surfaces of the REM oxysulfides-other than the cracks or fractures.

Figure 3:
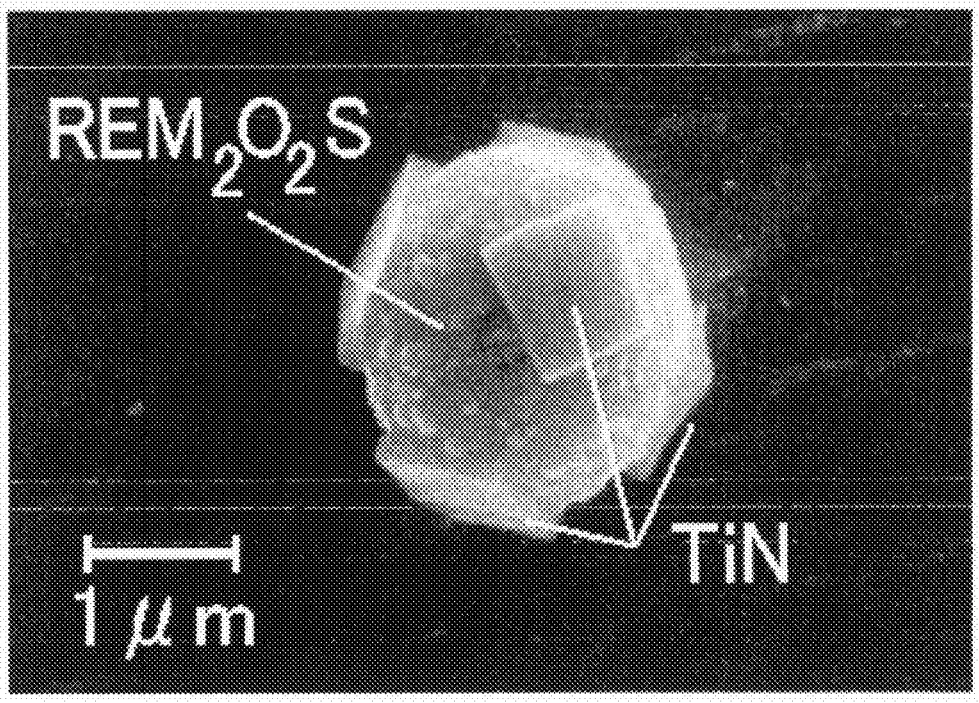
FIG. 3 is a view showing an inclusion comprised of an REM oxysulfide with TiN copresent on the surface.
Figure 4:
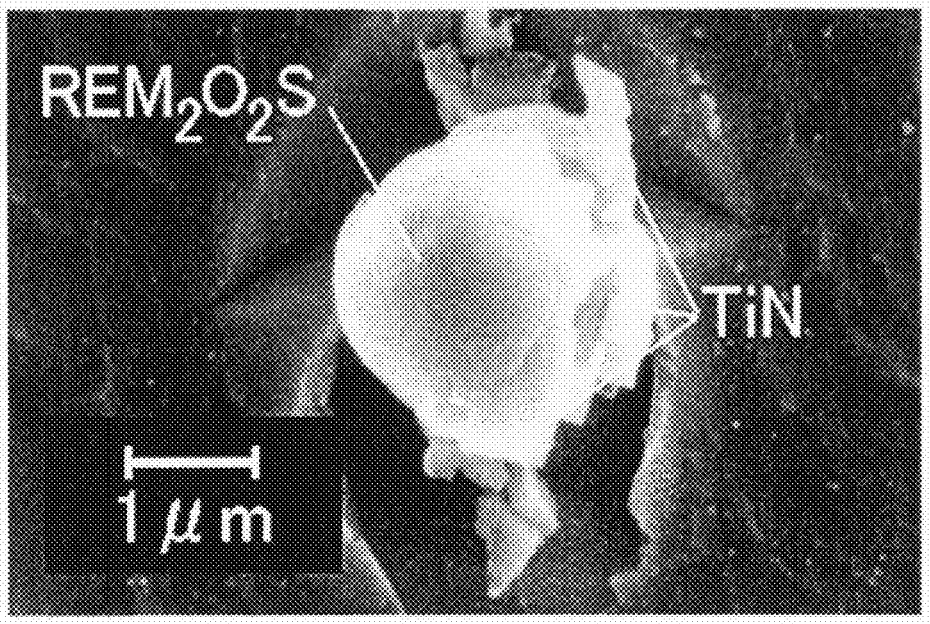
FIG. 4 is a view showing an inclusion comprised of an REM oxysulfide with TiN copresent at the fractures.

The REM oxysulfide shown in FIG. 3 is comprised of a spherical REM oxysulfide to the surface of which TiN particles are bonded. Further, the REM oxysulfide shown in FIG. 4 is a semispherical shape of the originally spherical REM oxysulfide broken in half vertically. A large number of TiN particles are bonded to the right side of the fracture.

As clear from a comparison of FIG. 3 and FIG. 4, the cracks or fractures of REM oxysulfides have greater numbers of TiN bonded to them in a stacked manner and have TiN particles grown to a larger size compared with surfaces other than the cracks or fractures.

In this way, the cracks or fractures of REM oxysulfides have larger, greater number of TIN particles bonded to them compared with surfaces other than the cracks or fractures.

That is, the fact that REM oxysulfides having cracks or fractures fix a greater amount of Ti and have a stronger effect of suppressing TiC precipitation compared with REM oxysulfides without cracks or fractures was newly discovered by the present inventors.

Still further, the fact that if a certain ratio of number of REM oxysulfides among the REM oxysulfides having cracks or fractures have TIN coprecipitated on them, the Ti will be more sufficiently fixed and the effect of suppression of precipitation of TiC during annealing will be made stronger was newly discovered by the present inventors.

Note that TiN also coprecipitates on REM oxysulfides that do not have cracks or fractures, but the amount of Ti fixed due to this, as mentioned above, is smaller than with the REM oxysulfides having cracks or fractures.

Consequently, if considering the effect of suppression the TiC precipitation, including REM oxysulfides having cracks or fractures in the steel is more advantageous.

Such REM oxysulfides having cracks or fractures, as explained above, are obtained by the crushing of REM oxysulfides which were substantially spherical before crushing due to the processing of the steel.

As explained above, according to the usual method of production of electrical steel sheet, usually at least one-third of the REM oxysulfides in the steel have cracks or fractures, but in other cases, sometimes even if processing the steel, REM oxysulfides having cracks or fractures will not be formed and the REM oxysulfides which were substantially spherical before crushing will remain as is in the steel.

In particular, if the size of the REM inclusions is less than 1 μm, cracks or fractures are difficult to form. On the other hand, REM inclusions having a size of over 5 μm often become a size of 5 μm or less due to stretching or crushing.

Consequently, the ratio of number of REM oxysulfides having cracks or fractures should be considered for particles of a size of 1 μm to 5 μm. Here, the "size" means the spherical equivalent diameter.

Considering the above, the inventors engaged in intensive studies and as a result discovered that when the mass % of S shown by [S], the mass % of O shown by [O], the mass % of REM shown by [REM], the mass % of Ti shown by [Ti], and the mass % of N shown by [N] satisfy the [Formula 1] and [Formula 2], REM oxysulfides are formed in the steel and TiN coprecipitates on the surfaces of the REM oxysulfides whereby Ti is fixed as TiN and the formation of TiC is suppress.

$$[REM]^2\times[O]^2\times[S]\geqq 1\times10^{-15} \quad \text{[Formula 1]}$$

$$([REM]^2\times[O]^2\times[S])\div([Ti]\times[N])\geqq 1\times10^{-10} \quad \text{[Formula 2]}$$

Further, they discovered that if the steel contains REM oxysulfides having cracks or fractures, when the ratio of number of REM oxysulfides bonded with TiN among the REM oxysulfides of a size of 1 μm to 5 μm having cracks or fractures is 5% or more, a larger amount of Ti is fixed on the REM oxysulfides as TiN and the effect of suppression of the formation of TiC is strengthened more.

Note that when the amount of Ti in the steel is excessive, not all of the Ti in the steel will be fixed as TiN in the REM inclusions. The excess Ti failing to form TiN will remain and due to this TiC will sometimes be formed.

Therefore, it is believed necessary that the amount of Ti be kept to a certain ratio or less of the amount of REMS.

Therefore, the inventors engaged in intensive studies and as a result discovered that if the steel includes REM inclusions having cracks or fractures, when the ratio of the REM inclusions bonded with TiN among the REM inclusions of a size of 1 μm to 5 μm having cracks or fractures is 5% or more and the mass % of REM shown by [REM] and the mass % of Ti shown by [Ti] satisfies [REM]÷[Ti]≧0.5, Ti is sufficiently fixed at the REM inclusions as TiN and the formation of TiC can be suppressed.

Below, the suitable ranges of ingredients described above will be explained in more detail using Table 1, Table 2, and FIG. 1 to FIG. 4.

Steels containing, by mass %, C: 0.0026%, Si: 3.0%, Al: 0.59%, and Mn: 0.21% and changed variously in the contents of O, S, Ti, N, and REM as shown in Table 1 were continuously cast and hot rolled. The hot rolled sheets were annealed, cold rolled to a thickness of 0.35 mm, finish annealed at 850° C.×30 seconds, and coated with an insulating film to prepare product sheets. The grain size of the product sheets was in each case within the range of 30 to 34 μm.

Next, these product sheets were stress relief annealed at 750° C.×1.5 hours or a shorter time than the conventionally generally performed stress relief annealing. After this, they were examined for inclusions, grain size, and magnetic properties. The results are shown in Table 2.

Note that in Table 2, "broken REM inclusions with TiN (%)" means the ratio of REM oxysulfides of a size of 1 μm to 5 μm with TiN coprecipitated among those having cracks or fractures.

Further, the ratios of numbers of REM oxysulfides having cracks or fractures with respect to the total numbers of REM oxysulfides in the steels were within the range of 35 to 65%.

TABLE 1

| | composition | | | | | | | | |
|---|---|---|---|---|---|---|---|---|---|
| No. | C (mass %) | Si (mass %) | Mn (mass %) | Al (mass %) | Ti (mass %) | S (mass %) | O (mass %) | N (mass %) | REM (mass %) |
| 1 | 0.0026 | 3.0 | 0.21 | 0.59 | 0.0012 | 0.0039 | 0.0042 | 0.0021 | 0.0019 |
| 2 | 0.0026 | 3.0 | 0.21 | 0.59 | 0.0021 | 0.0014 | 0.0017 | 0.0020 | 0.0044 |
| 3 | 0.0026 | 3.0 | 0.21 | 0.59 | 0.0016 | 0.0020 | 0.0009 | 0.0020 | 0.0049 |
| 4 | 0.0026 | 3.0 | 0.21 | 0.59 | 0.0039 | 0.0020 | 0.0015 | 0.0020 | 0.0052 |
| 5 | 0.0026 | 3.0 | 0.21 | 0.59 | 0.0045 | 0.0020 | 0.0022 | 0.0020 | 0.0090 |
| 6 | 0.0026 | 3.0 | 0.21 | 0.59 | 0.0197 | 0.0010 | 0.0011 | 0.0044 | 0.0035 |
| 7 | 0.0026 | 3.0 | 0.21 | 0.59 | 0.0089 | 0.0002 | 0.0009 | 0.0023 | 0.0263 |
| 8 | 0.0026 | 3.0 | 0.21 | 0.59 | 0.0026 | 0.0006 | 0.0007 | 0.0048 | 0.0019 |
| 9 | 0.0026 | 3.0 | 0.21 | 0.59 | 0.0109 | 0.0008 | 0.0011 | 0.0037 | 0.0020 |
| 10 | 0.0026 | 3.0 | 0.21 | 0.59 | 0.0195 | 0.0014 | 0.0005 | 0.0043 | 0.0037 |
| 11 | 0.0026 | 3.0 | 0.21 | 0.59 | 0.0011 | 0.0015 | 0.0004 | 0.0023 | 0.0015 |
| 12 | 0.0026 | 3.0 | 0.21 | 0.59 | 0.0014 | 0.0006 | 0.0005 | 0.0020 | 0.0024 |
| 13 | 0.0026 | 3.0 | 0.21 | 0.59 | 0.0022 | 0.0005 | 0.0004 | 0.0020 | 0.0030 |

TABLE 2

| No. | $[REM]^2[O]^2[S]$ | $[REM]^2[O]^2[S]/[Ti][N]$ | [REM]/[Ti] | broken REM inclusions with TiN (%) | REM-O—S | TiN on REM-O—S | TiC | grain diameter after annealing [μm] | W15/50 after annealing [W/kg] |
|---|---|---|---|---|---|---|---|---|---|
| 1 | $2.5 \times 10^{-13}$ | $9.9 \times 10^{-8}$ | 1.58 | 4.8 | yes | yes | no | 64 | 1.92 |
| 2 | $7.8 \times 10^{-14}$ | $1.9 \times 10^{-8}$ | 2.10 | 5.5 | yes | yes | no | 72 | 1.87 |
| 3 | $3.9 \times 10^{-14}$ | $1.2 \times 10^{-8}$ | — | 95 | yes | yes | no | 70 | 1.85 |
| 4 | $1.2 \times 10^{-13}$ | $1.6 \times 10^{-8}$ | — | 50 | yes | yes | no | 66 | 1.90 |
| 5 | $7.8 \times 10^{-13}$ | $8.7 \times 10^{-8}$ | — | 67 | yes | yes | no | 67 | 1.87 |
| 6 | $1.5 \times 10^{-14}$ | $1.7 \times 10^{-10}$ | 0.18 | — | yes | yes | no | 59 | 1.94 |
| 7 | $1.1 \times 10^{-13}$ | $5.5 \times 10^{-9}$ | 2.96 | — | yes | yes | no | 69 | 1.91 |
| 8 | $1.1 \times 10^{-15}$ | $8.5 \times 10^{-11}$ | — | — | yes | no | yes | 38 | 2.23 |
| 9 | $3.9 \times 10^{-15}$ | $9.6 \times 10^{-11}$ | — | — | yes | no | yes | 41 | 2.20 |
| 10 | $4.8 \times 10^{-15}$ | $5.7 \times 10^{-11}$ | — | — | yes | no | yes | 37 | 2.29 |
| 11 | $5.4 \times 10^{-16}$ | $2.1 \times 10^{-10}$ | — | — | no | n.a. | yes | 36 | 2.25 |
| 12 | $8.6 \times 10^{-16}$ | $3.1 \times 10^{-10}$ | — | — | no | n.a. | yes | 34 | 2.30 |
| 13 | $7.2 \times 10^{-16}$ | $1.6 \times 10^{-10}$ | — | — | no | n.a. | yes | 35 | 2.31 |

—: not measured
n.a.: not applicable

As shown in Nos. 1 to 7, when the $[REM]^2\times[O]^2\times[S]$ value of the steel was within the range of [Formula 1] and the $([REM]^2\times[O]^2\times[S])\div([Ti]\times[N])$ value was within the range of [Formula 2], the grain size after stress relief annealing, was 59 to 72 μm, that is, the grains grew sufficiently, and the magnetic property (core loss: W15/50) was a good 1.85 to 1.94 W/kg.

These steels contained REM oxysulfides. Further, as shown in FIG. 3 and FIG. 4, TiN coprecipitated on the surfaces of the REM oxysulfides. In addition, TiC was not formed after annealing.

From the above results, it is clear that when the ingredients of the product are within the ranges prescribed by the present invention, the REM in the steel forms REM oxysulfides, TiN coprecipitates on that whereby the Ti is fixed, and formation of TiC is suppressed.

Further, in particular, as shown by Nos. 2 to 5, when the steel sheet contained REM oxysulfides of a size of 1 μm to 5 μm having cracks or fractures and the ratio of the number of REM oxysulfides bonded with TiN among them was 5% or more, the grain size after stress relief annealing was 66 to 72 μm, that is, the grains grew further, and the magnetic property (core loss: W15/50) was a better 1.85 to 1.90 W/kg.

These steels contained REM oxides, REM sulfides, and REM oxysulfides. Among them, the inclusions of a size of 1 μm to 5 μm having cracks or fractures, as shown in FIG. 4, were observed to include a larger number of REM oxysulfides bonded with TiN. It was clear that the fixation of Ti was further strengthened. Further, after annealing, TiC was not formed in the product.

Note that as shown in FIG. 2, it is important that the ratio of the number of REM oxysulfides bonded with TiN among the REM oxysulfides of a size of 1 μm to 5 μm having cracks or fractures be 5% or more, but in this case, the larger the value, the more remarkable the effect. 20% or more is preferable, while 30% or more is more preferable.

The examples shown by Nos. 11 to 13 are cases where the $[REM]^2\times[O]^2\times[S]$ values are outside the range of [Formula 1]. REM oxysulfides were not observed in these steels. In addition, TiC could be observed. Due to this, crystal grain growth was obstructed. The grain size after stress relief annealing remained between 34 to 36 μm. The W15/50 value was around 2.3 W/kg, i.e., was poor.

In this case, REM oxysulfides were not observed in the steel. Consequently, TiN did not coprecipitate on the surfaces of the REM oxysulfide to fix the Ti, so the Ti precipitated as TiC in the stress relief annealing and obstructed crystal grain growth.

Due to the above, it became clear that the $[REM]^2\times[O]^2\times[S]$ value must be within the range of [Formula 1].

The examples shown by Nos. 8 to 10 are cases where the $[REM]^2\times[O]^2\times[S]$ values are within the range of [Formula 1], but the $([REM]^2\times[O]^2\times[S])\div([Ti]\times[N])$ values are outside the range of [Formula 2].

REM oxysulfides were observed in these steels. However, TiN could not be observed on the surfaces of the REM oxysulfides. In addition, TiC was observed. Due to this, crystal grain growth was obstructed. The grain size after stress relief annealing remained between 37 to 41 μm, and the W15/50 value was approximately 2.2 to 2.3 W/kg, i.e., was poor.

In this case, while REM oxysulfides were formed in the steel, TiN was not coprecipitated on the surfaces to fix the Ti. The Ti precipitated finely dispersed as TiC during stress relief annealing and obstructed crystal grain growth.

Due to the above, it became clear that the $[REM]^2\times[O]^2\times[S]$ must be within the range of [Formula 1] and the $([REM]^2\times[O]^2\ [S])\div([Ti]\times[N])$ value must be within the range of [Formula 2].

Note that it should be especially mentioned here, that when for example the amount of Ti is small such as in No. 11 and the like, conversely. TiC is sometimes formed.

According to conventional findings, the amount of Ti is preferably extremely small, so it was considered necessary to prevent the entry of Ti into the steel even with tremendous effort, but in the case of the present invention, great effort is not required for reducing the amount of Ti. In some cases, it is possible to positively add Ti to raise the amount of Ti in the steel from the amount of Ti unavoidably entering it so as to positively make TiN coprecipitate on the surfaces of the REM oxysulfides.

In the present invention, this coprecipitation enables Ti to be fixed, precipitation of TiC during the annealing to be eliminated, and good product characteristics to be stably obtained.

Further, in the cases of Nos. 1, 2, and 7 where the mass % of REM shown by [REM] and the mass % of Ti shown by [Ti] are within the range of $[REM]\div[Ti]\geqq 0.5$, the grain size after stress relief annealing was 67 to 72 μm, i.e., the grains sufficiently grew, and the magnetic property (core loss: W15/50) was a good 1.87 to 1.92 W/kg.

Note that the above results are results when performing the stress relief annealing in a shorter time than the conventionally performed stress relief annealing, but in the case of performing the conventional level of stress relief annealing, the difference in crystal grain growth due to the pinning action of the fine inclusions becomes more remarkable, so the above stated crystal grain growth potential and suitability of core loss become further clearer of course.

Further, the above was explained by the crystal grain growth potential in stress relief annealing after stamping where the effect of TiC particularly easily appears, but the same applies even in finish annealing of the cold rolled sheet before stamping.

In addition, so long as the element is REM, the above effect is exhibited if in the range prescribed in the present invention whether using just one type or two types or more in combination.

Next, the reasons for limitation of the preferable contents of the ingredients in the present invention will be explained.

[C]: C is not only harmful to the magnetic properties, but the precipitation of C results in remarkable magnetic aging, so the upper limit was made 0.01 mass %. The lower limit includes 0 mass %.

[Si]: Si is an element which decreases core loss. If less than the lower limit of 0.1 mass %, core loss becomes worse, so the lower limit was made 0.1 mass %. Further, if over the upper limit of 7.0 mass %, the processability becomes remarkably poor, so the upper limit was made 7.0 mass %.

Note that Si has the effect of raising the active amount of Ti in the steel, so if Si is higher, Ti precipitates are more actively formed, coprecipitation of TiN to REM oxysulfides is promoted more, the amount of Ti fixed per REM oxysulfide particle increases, and the numerical density of fine Ti precipitates in the steel is reduced more.

This effect is generally proportional to the square of the amount of Si, so the amount of Si is preferably higher. Specifically, the numerical density of fine Ti precipitates of a size of 100 nm or less in the steel becomes $1\times10^9/mm^3$ or less when the amount of Si is 2.2 mass % and becomes $5\times10^8/mm^3$ or less when the amount of Si is 2.5 mass %.

Consequently, the lower limit of the amount of Si is preferably 2.2 mass %, more preferably 2.5 mass %.

Further, a more preferable value as the upper limit of the amount of Si is 4.0 mass % where the cold rollability is better. If the upper limit is 3.5 mass %, the cold rollability becomes even better, so this is more preferable.

[Al]: Al is an element which, like Si, decreases core loss. If less than the lower limit of 0.1 mass %, the core loss worsens, while if over the upper limit of 3.0 mass %, the cost remarkably increases. The lower limit of Al, from the viewpoint of core loss, is preferably 0.2 mass %, more preferably 0.3 mass %, still more preferably 0.6 mass %.

[Mn]: Mn is added in an amount of 0.1 mass % or more to increase the hardness of the steel sheet and improve the stampability. Note that the upper limit of 2.0 mass % is based on economic reasons.

[N]: N becomes nitrides such as AlN and TiN and causes core loss to become worse. N is fixed in REM inclusions as TiN, but the practical upper limit is made an upper limit of 0.005 mass %.

Note that due to the above reasons, the upper limit is preferably 0.003 mass %, more preferably 0.0025 mass %, still more preferably 0.002 mass %.

Further, due to the above reasons, N is preferably as small as possible, but making it approach close to 0 mass % results in great industrial restrictions, so the lower limit is made over 0 mass %.

Note that the practical limit is set to 0.001 mass % as a general rule. If reducing the amount to 0.0005 mass %, the nitrides are suppressed, which is more preferable, while if reducing them to 0.0001 mass %, it is even more preferable.

[Ti]: Ti forms fine inclusions such as TiC, causes the crystal grain growth potential to deteriorate, and causes the core loss to worsen. Ti is fixed as TiN in the REM oxysulfides, but the practical upper limit was made an upper limit of 0.02 mass %.

Note that due to the above reasons, the upper limit is preferably 0.01 mass %, more preferably 0.005 mass %.

Further, Ti is an element which causes the crystal grain growth potential to deteriorate, so the smaller the amount the better. The lower limit is made over 0 mass %. However, as explained above, if the amount of Ti is too small, the effect of being fixed at the REM oxysulfides is sometimes not realized.

Consequently, when the amount of Ti satisfies the above evaluation formula [Formula 2], if the amount of Ti is over 0.0012 mass %, the effect of fixation at the REM oxysulfides becomes more reliable, so this is preferred. Further, if over 0.0015 mass %, it is even more preferable, further, if 0.002 mass % or more, it is more preferable, further, if 0.0025 mass % or more, it is still more preferable.

[REM]: REM forms oxysulfides to fix S and suppress the formation of fine sulfides other than REM oxysulfides. Further, it becomes the site for coformation of TiN and exhibits the effect of fixing the Ti.

For this reason, a content exceeding the amount required in accordance with the amount of Ti becomes necessary, but if 0.001 mass % or more, the above effect becomes more reliable so this is preferred. 0.002 mass % or more is more preferable, 0.0025 mass % or more is still more preferable, and 0.003 mass % or more is even more preferable.

Note that when casting molten steel with a content over the upper limit of 0.05 mass %, the REM oxysulfides in the molten steel become excessive, a large number of REM oxysulfides stick to the refractory walls of the molten steel channels in the casting system, and the molten steel channels are sometimes clogged. For this reason, the upper limit of REMs is made 0.05 mass %.

[S]: S becomes sulfides such as MnS, causes the crystal grain growth potential to deteriorate, and causes the core loss to worsen. S is fixed as REM oxysulfides, but the practical upper limit was made an upper limit of 0.005 mass %.

Further, due to the above reasons, S is preferably as small as possible, but reducing it to close to 0 mass % results in great industrial restrictions. Further, it is necessary for forming REM oxysulfides. Therefore, the lower limit was made over 0 mass %.

Note that the lower limit was made 0.0005 mass % as a general rule as a practical lower limit considering economy.

[O]: If O is included in an amount greater than 0.005 mass %, a large number of oxides are formed. These oxides obstruct domain wall displacement and crystal grain growth. Consequently, O is preferably made 0.005 mass % or less.

In addition, due to the above reasons, O is preferably as small as possible, but reducing it to close to 0 mass % results in great industrial restrictions. Further, it is necessary for forming REM oxysulfides. Therefore, the lower limit was made over 0 mass %.

Note that the lower limit was made 0.0005 mass % as a general rule as a practical lower limit considering economy.

Elements other than the above stated ingredients which do not greatly obstruct the effects of the steel of the present invention may be contained in the steel of the present invention.

Below, the optional elements will be described. Note that the lower limits of the contents are all made over 0 mass % because it is sufficient if these are included in even trace amounts.

[P]: P increases-the strength of the material and improves processability. However, if excessive, the cold rollability is impaired, so the content is made 0.5 mass % or less, more preferably 0.1 mass % or less.

[Cu]: Cu increases corrosion resistance and raises resistivity to improve the core loss. However, if excessive, scars etc. are formed on the surface of the product sheet and the surface quality is harmed, so the content is 3.0 mass % or less, more preferably 0.5 mass % or less.

[Ca] and [Mg]: Ca and Mg are desulfurization elements. They react with the S in the steel to form sulfides and thereby fix the S. However, unlike REMs, they have little effect of causing coprecipitation of TiN.

If increasing the amounts added, the desulfurization effect is strengthened, but if over the upper limit of 0.05 mass %, grain growth is obstructed by the excessive sulfides of Ca and Mg. Consequently, 0.05 mass % or less is preferable.

[Cr]: Cr increases corrosion resistance and raises resistivity to improve the core loss. However, excessive addition raises the costs, so 20 mass % was made the upper limit.

[Ni]: Ni promotes the formation of a texture structure advantageous to the magnetic properties and improves the core loss. However, excessive addition raises the costs, so 5.0 mass % was made the upper limit. Preferably 1.0 mass % is the upper limit.

[Sn] and [Sb]: Sn and Sb are segregation elements. They obstruct the formation of a texture structure of the (111) plane degrading the magnetic properties and thereby improve the magnetic properties.

These elements may be used alone or may be used in combinations of two types. The above effect is exhibited in both cases. However, if in excess of 0.3 mass %, the cold rollability deteriorates, so 0.3 mass % was made the upper limit.

[Zr]: Zr obstructs crystal grain growth even in trace amounts and cause core loss to worsen after stress relief annealing. Consequently, it is preferable to reduce it as much as possible to 0.01 mass % or less.

[V]: V forms nitrides and carbides and obstructs domain wall displacement and crystal grain growth. For this reason, it is preferably made 0.01 mass % or less.

[B]: B is a grain boundary segregation element. Further, it forms nitrides. These nitrides obstruct grain boundary migration and cause the core loss to worsen. Consequently, it is preferable to reduce it as much as possible to 0.005 mass % or less.

It is possible to add known elements other than the above as well. For example, as elements improving the magnetic properties, Bi, Ge, and the like can be suitably selected and used in accordance with the required magnetic properties.

Next, the preferable manufacturing conditions in the present invention and the reasons for setting them will be explained. First, at the steelmaking stage, when refining by a steel converter or secondary refining furnace or other ordinary method, the degree of oxidation of the slag, that is, the mass ratio of (FeO+MnO) in the slag, is made 1.0 to 3.0%.

The reason is that if the degree of oxidation of the slag is less than 1.0%, the activity of Ti rises due to the effect of Si within the range of the amount of Si of the electrical steel, so it is difficult to effectively prevent reintroduction of Ti from the slag and the amount of Ti in the steel will unnecessarily rise. On the other hand, if the degree of oxidation of the slag is over 3.0%, REM oxysulfides in the molten steel will unnecessarily be oxidized by the oxygen supply from the slag and become REM oxides and therefore the S in the steel will not sufficiently be fixed.

Furthermore, at the steelmaking stage, the basicity of the slag, that is, the ratio of the mass % of CaO to the mass % of $SiO_2$ in the slag, is preferably 0.5 to 5.

The reason is that if the basicity of the slag is less than 0.5, reintroduction of Ti from the slag will become large, the amount of Ti in the steel will easily unnecessarily rise, and the amount of addition of REM for fixing the Ti will become greater. On the other hand, if the basicity of the slag exceeds 5, the reintroduction of S from the slag will become large, the amount of S in the steel will easily unnecessarily rise, and the amount of addition of REM for fixing the S will become greater. In each case, it becomes economically disadvantageous.

Further, it is also important to consider the furnace refractories etc. and eliminate as much of the oxidation sources as possible. Furthermore, to secure sufficient time for the REM oxides unavoidably formed when adding REMs to float up, the time from addition of REMs to casting is preferably made 10 minutes or more.

The above stated measures are used to produce the molten steel of the desired composition, then the steel is continuously cast or cast into ingots to obtain slabs and other cast pieces.

After this, furthermore, the slabs are hot rolled and if necessary the hot rolled sheets are annealed and cold rolled once or twice or more with process annealing in between to finish them to the product thickness, then are finish annealed and coated with an insulating film.

Using the above method, the inclusions in the product sheet can be controlled to within the range prescribed by the present invention.

At this time, if making the reduction rate of the hot rolling higher, the REM inclusions in the steel will more easily be stretched or crushed and cracks or fractures will more easily occur, so this is preferable.

Note that if adjusting the distribution of the reduction rate to become higher at the rear stage side of the rolling, the shear force will more effectively act to cause the REM inclusions in the steel to crack or fracture, so this is preferable.

At this time, as the sheet thickness of the product is predetermined, in order to increase the reduction rate, a thicker slab becomes necessary. Therefore, there is a lower limit value to the required slab thickness.

When considering the fact that the general product sheet thickness of non-oriented electrical steel sheet is 0.2 to 0.7 mm or so, the slab thickness is preferably 50 mm or more, more preferably 80 mm or more, still more preferably 100 mm or more, and even more preferably 150 mm or more.

Further, when TiN coprecipitates at the cracks or fractures of the REM inclusions, it is possible to adjust the temperature history so that the TiN bonds to at least 5% of the number of the REM inclusions of a size of 1 μm to 5 μm having cracks or fractures. For example, the sheet is held in the temperature range of 1000° C. for 15 minutes or more.

EXAMPLES

Steel containing, by mass %, C: 0.0026%, Si: 3.0%, Al: 0.59%, and Mn: 0.21% and changed in contents of O, S, TiN, and REM as shown in Table 1 were continuously cast and hot rolled and the hot rolled sheets were annealed and cold rolled to thicknesses of 0.35 mm.

Next, the sheets were finish annealed at 850° C.×30 seconds and coated with an insulating film to produce the product sheets, then were annealed by stress relief annealing at 750° C.×1.5 hours, then examined for inclusions in the product sheets, examined for grain size, and examined for magnetic properties by the 25 cm Epstein method.

For the examination of inclusions, the inclusions were extracted by the replica method, then observed by using a TEM. The grain size was measured by mirror polishing the cross-section of the sheet thickness and applying Nital etching to bring out the crystal grains and measuring the average grain size.

As clear from Table 1 and Table 2, in the product sheets according to the present invention, good effects are obtained in regards to crystal grain growth and core loss values. On the other hand, in the product sheets outside the range prescribed by the present invention, inferior results are obtained in regards to crystal grain growth and core loss values.

INDUSTRIAL APPLICABILITY

As described above, by suitably controlling the. inclusions included in non-oriented electrical steel sheet, it is possible to stably obtain good magnetic properties even with simple annealing.

In particular, even by simple stress relief annealing, it becomes possible to stably obtain good magnetic properties. The needs of the consumers can be satisfied and energy savings can be contributed to.

Consequently, the present invention has great industrial applicability in industries relating to electrical steel sheet.

The invention claimed is:

1. Non-oriented electrical steel sheet superior in core loss characterized by containing, by mass %, C: 0.01% or less, Si: 0.1% to 7.0%, Al: 0.1% to 3.0%, Mn: 0.1% to 2.0%, N: 0.005% or less, Ti: 0.0016 to 0.02%, REM: 0.05% or less, S: 0.005% or less, O: 0.005% or less, and a balance of iron and unavoidable impurities and having a mass % of S shown by [S], a mass % of O shown by [O], a mass % of REM shown by [REM], a mass % of Ti shown by [Ti], and a mass % of N shown by [N] satisfying [Formula 1] and [Formula 2]:

$$[REM]^2\times[O]^2\times[S]\geqq 1\times10^{-15} \quad \text{[Formula 1]}$$

$$([REM]^2\times[O]^2\times[S])\div([Ti]\times[N])\geqq 1\times10^{-10} \quad \text{[Formula 2].}$$

2. Non-oriented electrical steel sheet superior in core loss according to claim 1, characterized by further containing, by mass %, at one least one of P: 0.5% or less, Cu: 3.0% or less, Ca and Mg: 0.05% or less, Cr: 20% or less, Ni: 5.0% or less, a total of one or both of Sn and Sb: 0.3% or less, Zr: 0.01% or less, V: 0.01% or less, and B: 0.005% or less.

3. Non-oriented electrical steel sheet superior in core loss according to claim 1 characterized by further containing, by mass %, REM: 0.00075% to 0.05% and having a mass % of REM shown by [REM] and a mass % of Ti shown by [Ti] satisfying [REM]÷[Ti]≧0.5.

4. Non-oriented electrical steel sheet superior in core loss according to claim 1 characterized in that the non-oriented electrical steel sheet contains REM oxysulfides having cracks or fractures and having a size of 1 μm to 5 μm and in that the ratio of the number of REM oxysulfides bonded with TiN in the REM oxysulfides having cracks or fractures and having a size of 1 μm to 5 μm is 5% or more.

* * * * *